US006406318B1

(12) United States Patent
Liao et al.

(10) Patent No.: US 6,406,318 B1
(45) Date of Patent: Jun. 18, 2002

(54) SOCKET WITH IMPROVED BASE

(75) Inventors: Fong-Chu Liao; Hsiang-Ping Chen, both of Tu-Chen (TW)

(73) Assignee: Hon Hai Precision Ind. Oc., Ltd., Taipei Hsien (TW)

( * ) Notice: Subject to any disclaimer, the term of this patent is extended or adjusted under 35 U.S.C. 154(b) by 0 days.

(21) Appl. No.: 10/013,382

(22) Filed: Dec. 7, 2001

(51) Int. Cl.[7] ..... H01R 4/50
(52) U.S. Cl. ..... 439/342; 439/259
(58) Field of Search ..... 439/342, 259, 439/265, 263, 266, 268

(56) References Cited

U.S. PATENT DOCUMENTS 5,722,848 A * 3/1998 Lai et al. ..... 439/342
5,833,483 A * 11/1998 Lai et al. ..... 439/342
6,042,413 A * 3/2000 Hsiao et al ..... 439/342
6,065,990 A * 5/2000 McHugh et al. ..... 439/342
6,113,411 A * 9/2000 Lu et al. ..... 439/342
6,152,757 A * 11/2000 Szu ..... 439/342
6,186,816 B1 * 2/2001 Lu et al. ..... 439/342
6,210,196 B1 * 4/2001 Wang et al. ..... 439/342
6,231,367 B1 * 5/2001 Hsiao et al. ..... 439/342
6,243,267 B1 * 6/2001 Chuang ..... 361/704
6,264,490 B1 * 7/2001 Lemke et al. ..... 439/342

* cited by examiner

*Primary Examiner*—Tho D. Ta
*Assistant Examiner*—Phuong Nguyen
(74) *Attorney, Agent, or Firm*—Wei Te Chung

(57) ABSTRACT

A socket (1) mounted on a mother board (5) includes a base (2), an array of conductive contacts (224) retained in the base, a sliding cover (3) and an actuating lever (4). The base includes a body (22) and a mounting portion (21) at a rear end thereof, the body comprising a plurality of through holes (223) for receiving the contacts, the mounting portion having a first surface (212) and a second surface (211) at a bottom thereof. A vertical offset (20) is defined between the first surface and the second surface for compensating for a space formed between the first surface and the mother board due to thermal stress during soldering.

4 Claims, 6 Drawing Sheets

SOCKET WITH IMPROVED BASE

BACKGROUND OF THE INVENTION

1. Field of the Invention

The present invention relates to a socket connector mounted on a mother board, and particularly to a ball grid array (BGA) socket with an improved base to reduce the height of a space formed between the socket and the mother board due to thermal stress during soldering process.

2. Description of Related Art

BGA sockets are widely used in computer industry for electrically connecting a central processing unit (CPU) to a mother board. A conventional BGA socket 9 mounted on a mother board 8 is disclosed in FIGS. 5–7. The BGA socket 9 generally comprises an insulative base 91, an array of conductive contacts 952 retained in the base 91, and a cover 92 movably mounted on the base 91. A corresponding number of solder balls 954 are attached to lower ends of the conductive contacts 952 for soldering onto the underlying mother board 8 by infrared (IR) generally. The base 91 may be warped due to thermal stress, and a space 93 is formed between a bottom surface 94 of the base 91 and the mother board 8. If the height of the space 93 is beyond allowable tolerance, the solder ball 954 could not be soldered with the mother board 8.

Hence, a BGA socket having an improved base is required to overcome the disadvantages of the conventional socket.

SUMMARY OF THE INVENTION

Accordingly, the object of the present invention is to provide a BGA socket having an improved base to reduce the height of a space formed between the socket and a mother board due to thermal stress during first and second IR soldering processes.

In order to achieve the object set forth, a BGA socket of the present inventing comprises a base, an array of conductive contacts retained in the base, a sliding cover and an actuating lever. The base includes a rectangular body and a mounting portion at a rear end thereof. The body comprises a plurality of through hole for receiving the contacts, and the mounting portion has a first surface and a second surface at the bottom. The first surface and the second surface define a vertical offset therebetween for compensating for a space between the first surface and the mother board caused by thermal stress during soldering.

Other objects, advantages and novel features of the invention will become more apparent from the following detailed description when taken in conjunction with the accompanying drawings.

DETAILED DESCRIPTION OF THE INVENTION

Figure 1:
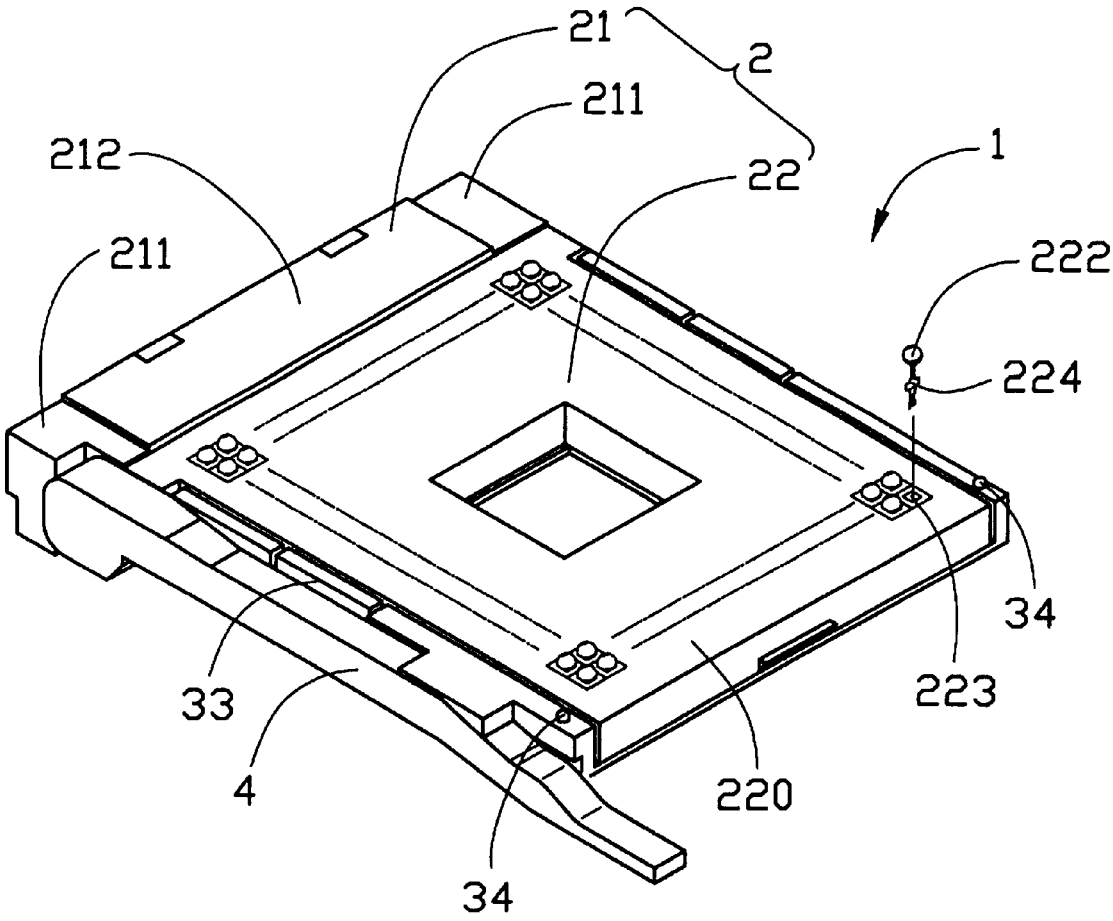
FIG. 1 is a bottom perspective view of a BGA socket in accordance with the present invention.

Reference will now be made to the drawing figures to describe the present invention in detail.

Figure 2:
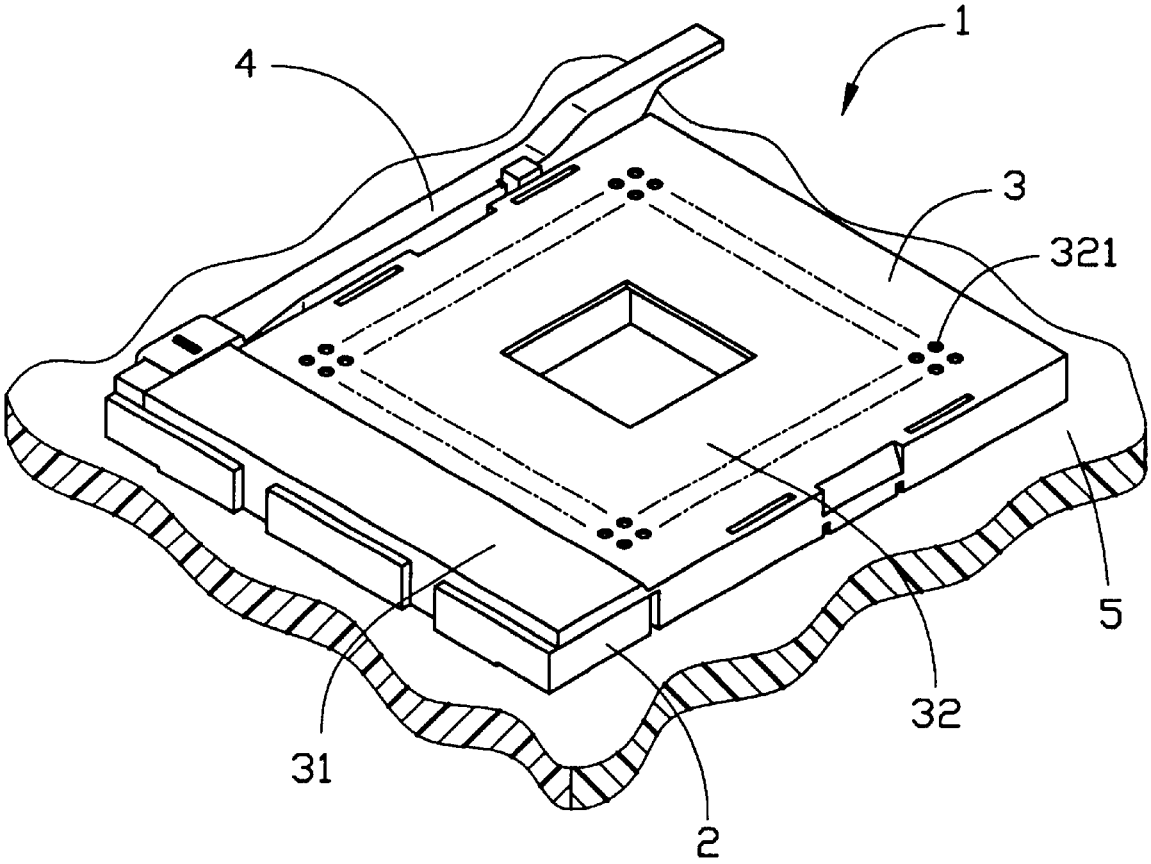
FIG. 2 is a top perspective view of the BGA socket of FIG. 1 mounted on a mother board.

Referring to FIGS. 1 and 2, a BGA socket 1 of the present invention comprises a base 2, an array of conductive contacts 224 retained in the base 2, a sliding cover 3 and an actuating lever 4.

The base 2 includes a rectangular body 22 and a mounting portion 21 at a rear end thereof. The body 22 comprises a plurality of through holes 223 for receiving the contacts 224. The mounting portion 21 defines a mounting surface 212 and a pair of depressed surfaces 211 on opposite sides of the mounting surface 212. A vertical offset 20 (FIG. 3) is defined between the mounting surface 212 and the depressed surface 211.

The sliding cover 3 comprises a rectangular cover flame 32 and a ledge 31 at a rear end thereof for receiving a portion of the actuating lever 4. The cover flame 32 includes a plurality of receiving holes 321 respectively aligned with the through holes 223 of the base 2 for receiving corresponding pins of a CPU (not shown), and a pair of sidewalls 33 engaging with opposite sides of the base 2. A pair of protrusions 34 respectively project downwardly from Front ends of the opposed sidewalls 33. Each protrusion 34 has a bottom contact point coplanar with the mounting surface 212 of the base 2. The actuating lever 4 operates between the cover 3 and the base 2 for driving the cover 3 to move longitudinally along the base 2, thereby moving pins of the CPU into electrical connection with the contacts 224.

Figure 3:
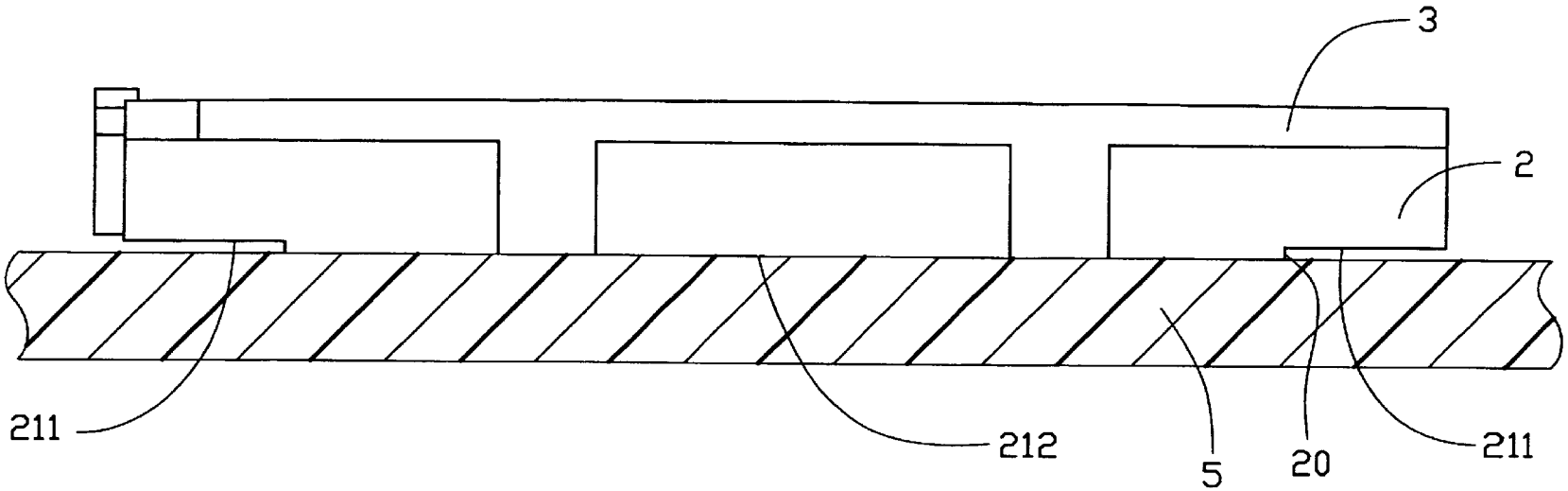
FIG. 3 is a rear view of FIG. 2, illustrating the positional relation between the BGA socket and the mother board before a soldering process.
Figure 4:
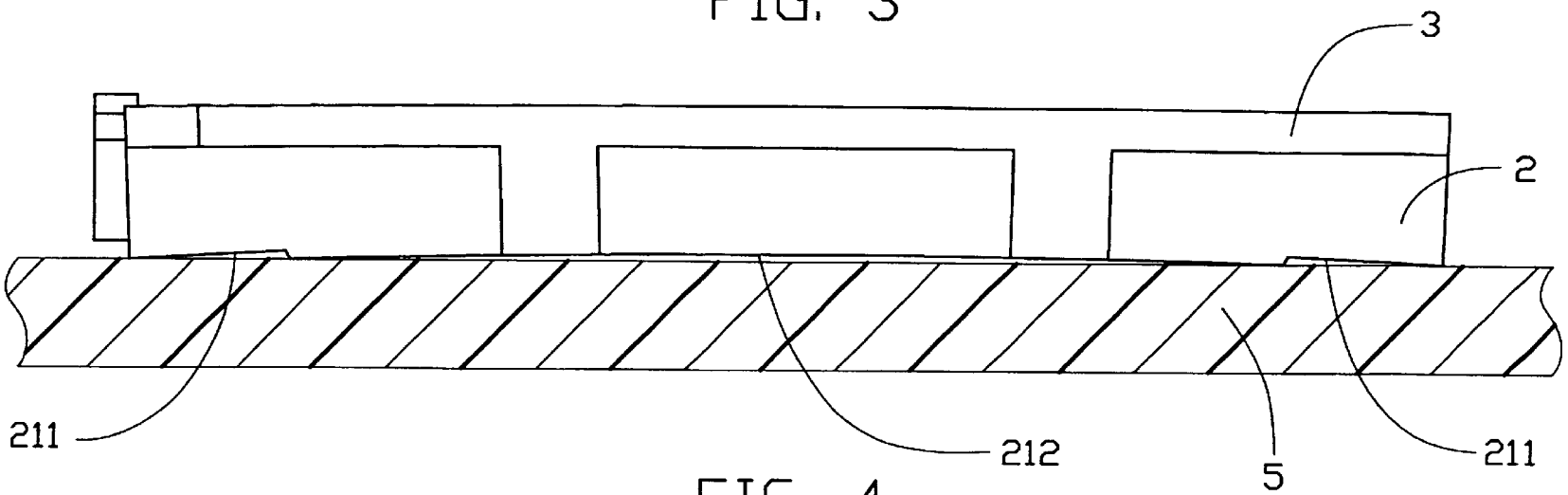
FIG. 4 is view similar to FIG. 3, but illustrating the positional relation between the BGA socket and the mother board after a soldering process.
Figure 5:
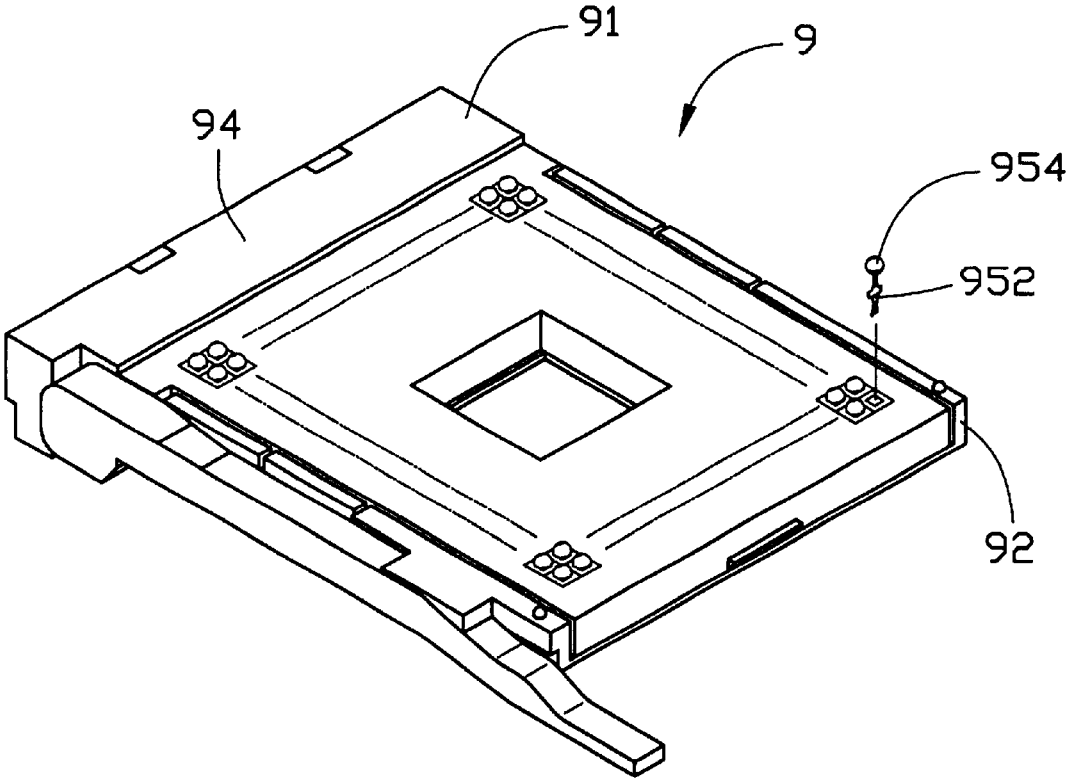
FIG. 5 (PRIOR ART)
FIG. 5 is a bottom perspective view of a conventional BGA socket.
Figure 6:
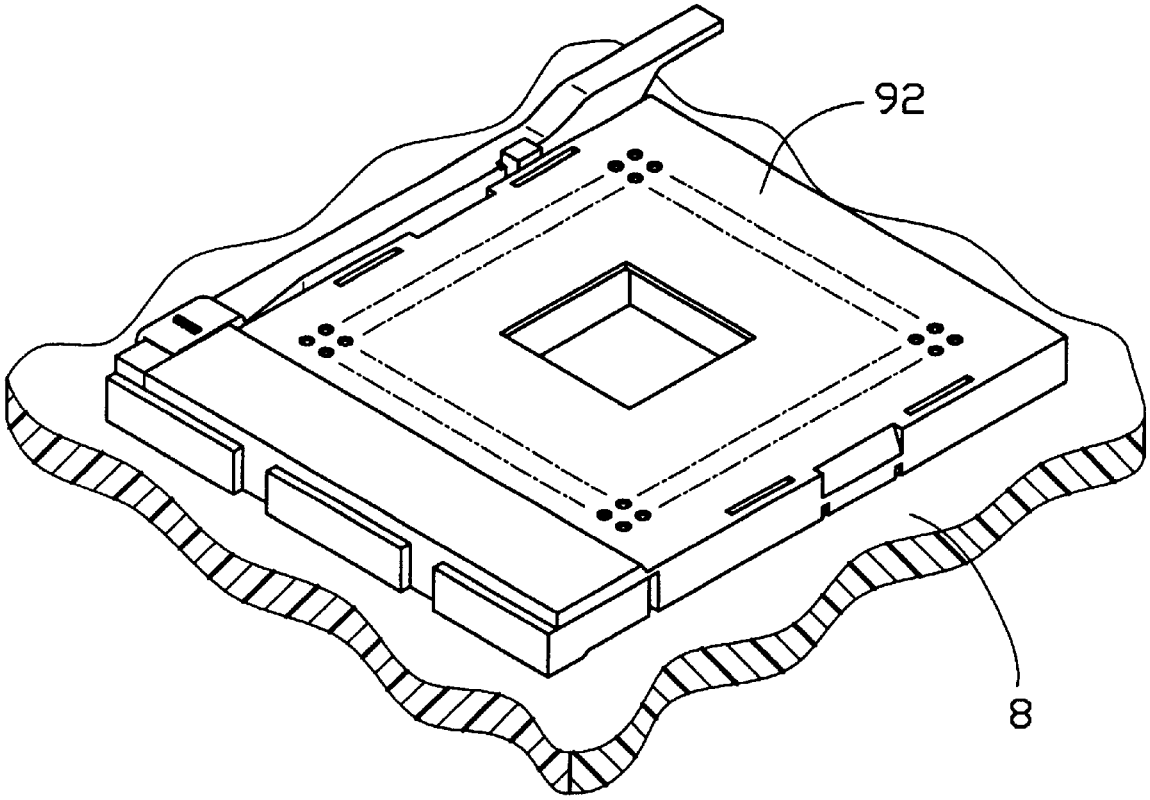
FIG. 6 (PRIOR ART)
FIG. 6 is a top perspective view of a conventional BGA socket mounted on a mother board.
Figure 7:
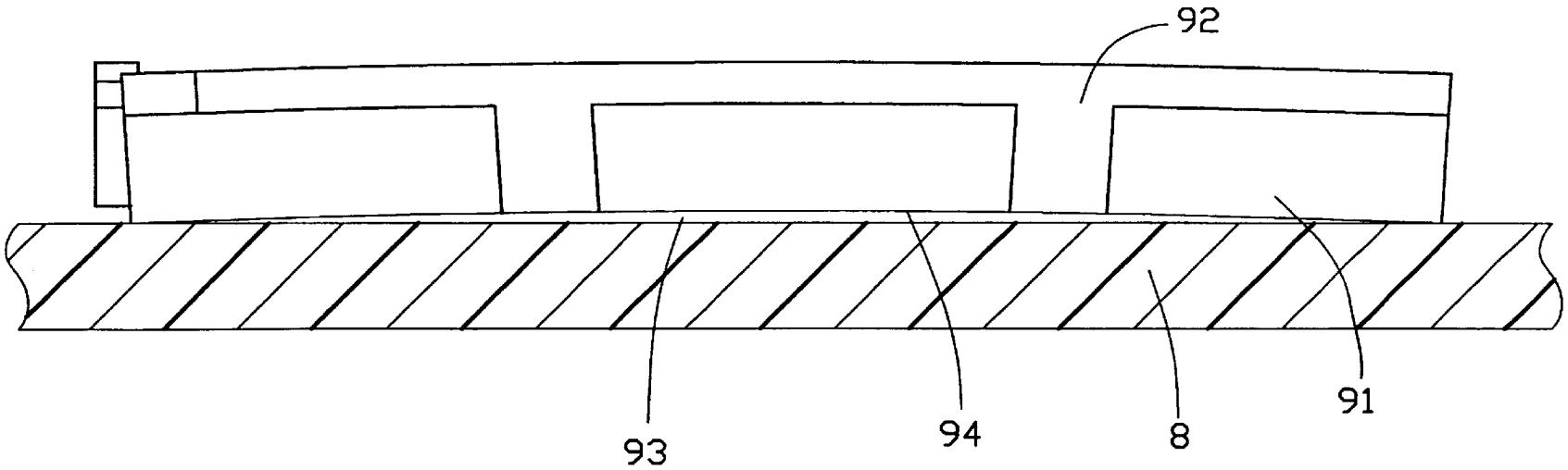
FIG. 7 (PRIOR ART)
FIG. 7 is a side view of FIG. 6, illustrating the positional relation between the BGA socket and the mother board after a soldering process.

Also referring to FIGS. 3–4, when the BGA socket 1 is positioned on the mother board 5, a plurality of solid solder balls 222 soldered to the contacts 224 in advance is situated therebetween. The solder balls 222 support the BGA socket 1 on the mother board 5 such that a lower surface 220 (FIG. 1) of the BGA socket 1 is spaced from the mother board 5. The solder balls 222 are heated and become molten to electrically connect tails of the contacts 224 to the mother board 5. With the solder balls 2 in molten state, the protrusions 34 of the cover 3 and the mounting surface 212 of the mounting portion 21 are so designal that they will abut against the mother board 5. It should be understood that the protrusion 34 may be formed on lower surface 220 of the base 2. Thus, the BGA socket 1 remains parallel to the mother board 5 as shown in FIG. 3. However, as stated above, the thermal stress during soldering may cause the socket 1 to be warped and to form a space (similar to the space 93 shown in FIG. 7) between the mounting surface 212 and the mother board 5. Due to the vertical offset 20 between the mounting surface 211 and the depressed surface 211, the space reduced to fall within tolerance, i.e., reduced space would not prevent the solder balls 222 from contacting with the mother board 5, thereby ensuring a reliable electrical connection between the CPU and the mother board 5.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A socket assembly comprising:

a printed circuit board;

an insulative base mounted on the printed circuit board with a plurality of contacts each with a solder ball at a bottom end thereof, said base defining a mounting portion on a bottom periphery thereof, said mounting portion defining a first surface around a middle portion thereof and a second surface around a side region thereof;

wherein between the first surface and the second surface is defined a vertical offset for reducing a space formed between the first surface and a mother board due to warpping under thermal stress of the mounting portion; wherein before soldering, the first surface is closer to the printed circuit board than the second surface; after soldering, the first surface is deformed away from said printed circuit board while the second surface is deformed toward said printed circuit board wherein before soldering the first surface is seated upon the printed circuit board while after soldering the second surface is seated upon the printed circuit board.

2. The socket as described in claim 1, further comprising a cover movably mounted on the base.

3. The socket as described in claim 1, further comprising an actuating lever disposed between a rear end of the cover and the mounting portion of the base.

4. The socket as described in claim 1, wherein the cover comprises a protrusion downwardly projecting from a front end thereof, the protrusion having a bottom contact point coplanar with the first surface of the base for supporting the socket on the mother board.

* * * * *